US005320646A

United States Patent [19]

Patton et al.

[11] Patent Number: 5,320,646

[45] Date of Patent: Jun. 14, 1994

[54] PROCESS FOR IMPROVING THE DYEABILITY OF FABRICS AND FIBERS

[75] Inventors: Robert T. Patton, Lake Jackson; Stephen E. Hill, Angleton; Dorothy L. Roerden, Lake Jackson, all of Tex.

[73] Assignee: The Dow Chemical Company, Midland, Mich.

[21] Appl. No.: 42,918

[22] Filed: Apr. 14, 1993

Related U.S. Application Data

[63] Continuation-in-part of Ser. No. 887,730, May 22, 1992, abandoned.

[51] Int. Cl.[5] ..... D06M 13/35; D06M 13/33

[52] U.S. Cl. ..... 8/188; 8/115.61; 8/115.64; 8/115.65; 8/116.1; 8/127.6; 8/181

[58] Field of Search ..... 8/188, 181, 127.6, 115.65, 8/116.1, 115.61, 115.64

[56] References Cited

U.S. PATENT DOCUMENTS

| | | | |
|---|---|---|---|
| 3,685,953 | 8/1972 | Cuvelier et al. | 8/115 |
| 3,853,460 | 12/1974 | Balland | 8/188 |
| 4,035,145 | 7/1977 | Gipp et al. | 8/188 |
| 4,072,464 | 2/1978 | Balland | 8/576 |
| 4,106,903 | 8/1978 | Langheinrich et al. | 8/188 |
| 4,149,849 | 4/1979 | Koch et al. | 8/188 |
| 5,006,125 | 4/1991 | Patton et al. | 8/188 |

FOREIGN PATENT DOCUMENTS

| | | | |
|---|---|---|---|
| 2527962 | 1/1977 | Fed. Rep. of Germany | 8/188 |
| 1129990 | 3/1982 | Fed. Rep. of Germany . | |
| 3129990 | 3/1982 | Fed. Rep. of Germany . | |
| 1381869 | 11/1972 | Switzerland . | |

OTHER PUBLICATIONS

Rupin et al., *Textilverdlung*, 1970, vol. 5, No. 11 pp. 829–838.

Derwent abstract of Jap. Pat. Reports, 1964, p. 3, #5985/64.

Journal Of The Society of Dyers and Colourists, Evans et al., Oct. 1984, pp. 304–315.

"Technical Information [sheet]: The Reaction of Cotton with Quat 188," Dow Chemical U.S.A. Form No. C-98030 192-951-885 dated Nov. 1992.

*Primary Examiner*—Prince Willis, Jr.
*Assistant Examiner*—Alan D. Diamond

[57] ABSTRACT

A process for improving the dyeability of fabrics or fibers comprising polyhydroxylzed polymers by the use of at least one compound selected from the group consisting of a compound of the formula;

(I)

(II)

and mixtures thereof, wherein R, R', R'' and R''' are lower alkyl radicals having 1 to 20 carbon atoms and X is selected from the group consisting of sulfate, sulfonate and halide. The process requires that a dry cauticized fabric be treated with a dilute solution of a lower alkyl ammonium salt so that the fabric contains less than about 50% by weight of water prior to curing.

29 Claims, 1 Drawing Sheet

PROCESS FOR IMPROVING THE DYEABILITY OF FABRICS AND FIBERS

CROSS REFERENCE TO RELATED APPLICATION

This application is a continuation in-part of commonly owned copending application Ser. No. 07/887,730 filed May 22, 1992, now abandoned the disclosure of which is incorporated herein by reference.

FIELD OF THE INVENTION

The present invention relates to a process for improving the printability or dyeability of textile fibers and fabrics. More particularly, the invention relates to an improvement over the process disclosed in U.S. Pat. No. 3,685,953 for printing or dyeing of polyhydroxylized polymers, such as cellulosic fibers and/or fabrics, by the pretreatment with an epoxy alkyl ammonium salt prior to dyeing or printing.

BACKGROUND OF THE INVENTION

In the dyeing of cellulosic textile materials and/or the printing thereof, it has been recognized that it is necessary to utilize various reactive compounds of an electropositive character to improve the fixing of the dyestuff on the fabric. Dyestuffs are employed of different characteristics for different textile material and, in general, some fabric are less susceptible to dyeing with certain dyestuffs. Consequently, it has been recognized that there are certain additives which can be used to treat the fabric beforehand and/or simultaneously with the dyestuff to improve dye takeup and the fixing of the dyestuff to the fabric.

It is known to use an epoxy ammonium compound having the following formula:

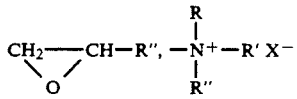

(I)

wherein R, R', and R'' are alkyl radicals having from 1 to 20 carbon atoms R''' is an alkylene radical having from 1 to 20 carbon atoms, while X— is an anionic group such as the sulfate group, the sulfonate group or a halide group. The halides which may be used are fluoride, chloride, bromide or iodide.

The additive may be utilized in two distinct processes. The epoxy compound may be applied to the textile material within the dyeing bath or the printing pastes, i.e. in the presence of the dyestuff which is to be taken up by the textile material. Also, the fabric prior to carrying out the dyeing process can be treated with the epoxy compound.

It is known to fix the additive to cellulosic materials in the presence of an alkaline substance whose concentration increases inversely with the treatment temperature. In other words, higher concentrations of the alkaline substance are necessary with lower temperatures, and higher temperatures are required when lower concentrations of the alkaline substance are used. Generally, the alkaline substance is a strong base, preferably caustic soda, and extremely high concentrations are applied by the prior art to ensure fixation at low temperatures.

However, treatments at elevated temperatures have become preferable to lowertemperature treatments utilized in the prior art because of faster processing and higher yields obtainable in industrial equipment.

It is known that treatment of the textile material at high temperature, after it has been impregnated with the epoxypropylammonium salt, gives rise invariably to a strong yellowing thereof. The yellowing may not be removed in the course of the usual subsequent treatments.

Such yellowing constitutes a considerable handicap to the use of the epoxypropylammonium salts at high temperatures.

The yellowing modifies or dulls the desired color and makes it impossible to obtain a white background in the printing of fabrics.

U.S. Pat. No. 3,685,953 to Cuvelier et al discloses a process of treating a hydrolyzed polymer such as cellulose with an epoxypropylammonium salt of the invention or the corresponding chlorohydrin and then drying at a high temperature. However, the process results in low yields.

U.S. Pat. No. 3,853,460 to Balland relates to the use of alkylsulfosuccinates and alkylsulfosuccinamates with epoxypropylammonium salts to prevent hydrolysis of the compound to the dihydroxy compound.

U.S. Pat. No. 4,072,464 to Balland relates to the use of boric acid with an epoxypropylammonium salt to improve dye penetration of a cellulosic fabric and to decrease yellowing. The fabric is then heat treated at an elevated temperature.

U.S. Pat. No. 4,035,145 relates to the use of N-(2,3-epoxyalkyl) ammonium salts such as N-methyl-N-(2,3-epoxypropyl)-morpholinium chloride in the presence of alkaline compounds to improve the dyeability of cellulosic textiles.

U.S. Pat. No. 5,006,125 to Patton et al discloses the use of an epoxypropyl ammonium salt or the corresponding chlorohydrin to improve the bleaching process of cellulosic fabrics.

It is understood that the term "polyhydroxylized polymer" as used herein relates to natural and synthetic polymers containing free hydroxyl groups which include cotton, flax, linen, rayon, polyvinyl alcohol, and the like.

The term "fabric" as used herein refers to fibers, yarns, tows, mats, battings, cloth, and the like which comprise the polyhydroxylized polymer alone or in blends with other natural or synthetic fibers such as wool, polyester, nylon, etc.

SUMMARY OF THE INVENTION

The invention provides an improved process for increasing the printability and/or dyeability of fabrics containing polyhydroxylized polymers. According to the process the fabrics are first treated with a dilute alkaline solution and then the fabric is dried to an absorbent state. Dependent on the ambient humidity, the percentage of on weight fabric (OWF) water is typically about 8%, i.e. typically about 8% moisture by weight of dry fabric. Preferably, the fabric is dried so that the percentage of on weight fabric water is less than about 8%. The dried fabric is then treated with a dilute solution of at least one compound selected from the group consisting of:

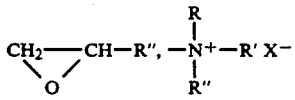

(I)

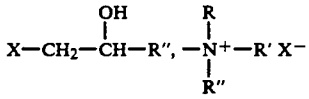

(II)

and a mixture thereof, wherein R, R', and R'' are alkyl radicals having from 1 to 20 carbon atoms, R''' is an alkylene radical having from 1 to 20 carbon atoms, and X is selected from the group consisting of sulfate, sulfonate and halide. Advantageously, an aqueous solution containing 0.1 to 10% by weight, preferably about 0.1 to 4% by weight of the epoxy is utilized. Immediately after application of the epoxy ammonium salt solution, the fabric is dried and heated at an elevated temperature to fix the epoxy compound.

Advantageously, the treating solution containing the epoxyammonium salt is substantially free of any dihydroxyalkyltrialkylammonium salts which result from the hydrolysis of the epoxy compound in the presence of water at an alkaline pH. The formation of the dihydroxyalkyltrialkylammonium salts has been found to constitute the primary yield loss in the reaction of the epoxy compound with cellulose. Cooling the treating solution temperatures below ambient conditions, preferably to about 0 deg. C., retards the hydrolysis reaction.

It is therefore an object of the present invention to provide an improvement in printability and dyeability of fabrics comprising polyhydroxylized polymers by preconditioning the fabrics prior to dyeing or printing.

It is a further object of the invention to improve the fixation yield of the epoxy ammonium salt of formula I on cellulosic fabrics over that disclosed in U.S. Pat. No. 3,685,953.

It is yet another object of the invention to improve printability and dyeability of cellulosic fabrics without yellowing.

DESCRIPTION OF THE PREFERRED EMBODIMENT

Figure 1:
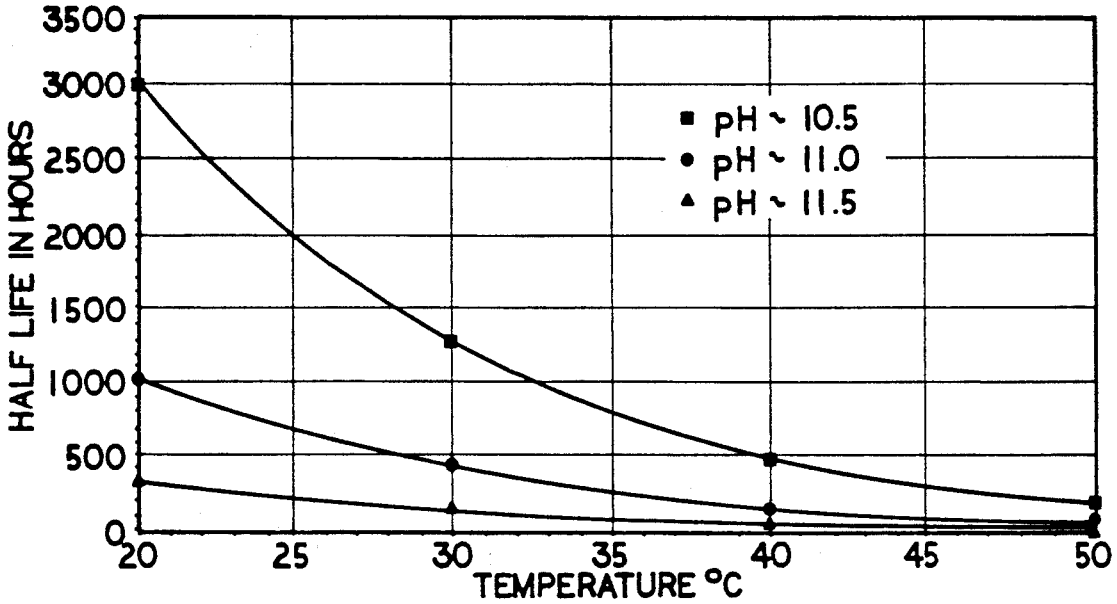
FIG. 1 shows the half life of epoxidized Quat 188, i.e. 65% 3-chloro-2-hydroxy propyltrimethylammonium chloride, with regard to temperatures at a pH of 10.5 to 11.5.

Although specific terms are used in the following description for the sake of clarity, these terms are intended to refer only to the particular structure selected for illustration, and are not intended to define or limit the scope of the invention.

The objects and advantages of the present invention are obtained by the fixation of textile fabrics comprising polyhydroxylized polymers, such as cellulosic fibers, with an epoxy ammonium salt of the formula:

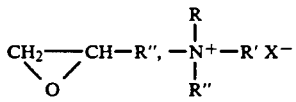

(I)

-continued wherein R, R' and R'' are alkyl radicals each independently having 1 to 20 carbon atoms, R''' is an alkylene radical having from 1 to 20 carbon atoms, and X− is an anion selected from the group consisting of sulfate, sulfonate and halide. R, R' and R'' can be either lower alkyl or the higher alkyl groups, while R''' is preferably a lower alkyl group, that is, less than eight carbon atoms, and most preferably R''' is methylene.

Representative of the preferred compounds of formula I include epoxypropyldiethylmethylammonium iodide, epoxypropyldiethylmethylammonium sulfate, epoxypropyltrimethylammonium chloride, epoxypropyldimethyloctylammonium chloride, and the like.

In order to increase the yield of fixation of the epoxy ammonium salt of formula I, or the halohydrin of formula II, it is essential that the fabric is first treated with an effective amount of an alkaline substance selected from alkali metal hydroxide, alkaline earth metal hydroxide, or mixtures thereof, preferably in the form of a dilute solution. The alkaline solution should have a concentration less than 10% by weight, preferably about 2 to 4% and should be applied at a rate of less than 4% NaOH (dry basis) OWF to minimize irreversible yellowing of the fabric during the drying or curing steps. Optionally, a small but effective amount of sodium sulfite or other compatible reducing agent, e.g. preferably from about 0.1 to about 10 percent by weight of the solution, more preferably from about 1 to about 4 weight percent, can be added to the alkaline solution to inhibit the formation of oxycellulose and thereby aid in minimizing yellowing. Use of sodium sulfite or other reducing agent is generally known in the art to be useful in minimizing yellowing of cellulosic fabric during processing steps carried out at elevated temperature. The molar ratio of base on the fabric to epoxy compound or halohydrin being applied to the fabric is optimally from about 5:1 to 6:1, but this ratio may vary depending on the particular fabric and the amount of epoxy compound or halohydrin being applied. Any one or more of the alkali metal hydroxides or alkaline earth metal hydroxides or mixtures thereof may be utilized. The alkaline hydroxides are preferred and sodium hydroxide is most preferred.

It is known that the etherate group which is formed when the fabric is treated with a dilute alkali metal hydroxide solution is more reactive with an epoxy group than it is with a hydroxyl. It is further known that the alkali metal etherate form of the hydroxyls do not exist to any useful degree in the presence of water.

It is also critical to achieving fixation of a higher amount of the epoxy form of the compound that the fabric is dry. That is, the amount of water present in the fabric prior to treatment with the epoxy compound should be less than about 8% on weight fabric, preferably less than about 0.5% on weight fabric in order to achieve uniform reagent application rapidly utilizing minimum water. The drying step conditions are not critical, but in combination are selected so as to accomplish drying to an absorbent state as promptly as is practical without causing irreversible yellowing. For example, drying of the fabric can be achieved at ambient pressure by drying at a temperature between about 70° to 150° C. and preferably in a low humidity atmosphere to minimize take up of any water from the atmosphere prior to treatment with the epoxy compound of formula I. As used herein, "low humidity" means an environment in which dry heat, rather than directly applied steam, is utilized as a source of thermal energy. With some drying equipment which can be used in practicing this invention, particularly heated rolls known as drying cans such as those available from Greenville Machinery Corp., Greenville, S.C. U.S.A., or Morrison Textile Machinery Co., Ft. Lawn, S.C. U.S.A., commonly used in the textile industry to dry broad woven textiles, the atmosphere in the vicinity of the equipment is humid because of water being driven off, but sufficiently rapid drying nevertheless results because the water of evaporation is allowed to dissipate rather than being deliberately confined or maintained by the addition of steam or water to the fabric.

The cellulosic fabric, having been treated with alkali metal hydroxide or other alkaline substance and dried, is left in a somewhat swollen state with sodium or other alkali ions remaining inside of the fiber. In this state, the cellulose fiber is capable of very rapidly imbibing an aqueous solution such as the aqueous solution of the epoxy compound. This rapid imbibition, along with the fact that the sodium or other alkali ions are already located within the fiber close to the desired reaction sites, allows a reduction in the time that the epoxy compound is in the presence of both alkali pH and water before the fabric can be flash dried to restore the reactive alkali metal etherate ligands. The epoxy compound is prone to hydrolyze in the presence of water, high pH, and high temperature. A reduction in the time during which the epoxy compound is exposed to these conditions is reflected in higher yield of the reagent ultimately reacted with the cellulosic medium. Hence the most desirable application of epoxy reagents is done from a solution which itself is at neutral pH but to a fabric which has been treated with an alkali hydroxide, and this application is followed as quickly as possible with flash drying.

When the dry fabric with the etherate groups is wetted with the dilute aqueous solution of the reagent of formula I or II, respectively, a concentration of about 0.1% to 10% by weight reagent is used, and preferably, about 0.1% to 4% by weight. The dilute solution permits rapid penetration into the fibers and ultimately shortens the time required to take the epoxy/cellulose system to reaction conditions.

The reagent solution containing at least one compound of formula I or II is applied so that the fabric is wetted to achieve substantially uniform distribution of the reagent throughout the fabric, which may require a wet pickup of as little as about 10 weight percent solution by weight of dry fabric. Using conventional dip and pad equipment, the wet pickup at the conclusion of this step of the process is usually at least about 50 weight percent solution by weight dry fabric but not more than about 125%, preferably and more commonly not more than about 100% (which is equivalent to the wetted fabric containing less than about 55 weight percent water and less than about 50 weight percent water, respectively, by weight of the wet article). If a different application technique is used, such as applying the reagent solution as a spray or foam, or if the fabric is passed across a vacuum slot to remove excess reagent solution, the wet pickup at the conclusion of this step can be less than about 50 % solution by weight dry fabric. Excess water is to be avoided since it necessitates a longer drying time to get to practical reactive conditions.

The fabric is then heated and rapidly dried so as to cure or fix the epoxy compound in the fibers. Preferably, the heating is carried out as a flash drying operation in a low humidity environment to minimize the time at elevated temperature with water and reactive epoxy compound present because such conditions also promote hydrolysis of the epoxide to a dihydroxide and thereby reduce the yield of epoxide on the fabric. The heating preferably is at a temperature of at least about 70° C., more preferably at least about 100° C. Upper temperatures of about 180° C., preferably about 120° C. are sufficient. The fabric is heated at the preselected temperature for a period of time sufficient to effect the fixation without causing irreversible yellowing. Typically heating for about 2 to 5 minutes, preferably about 3 minutes, is sufficient. When a reducing agent is optionally employed to aid in minimizing yellowing, a heat treatment at from about 120° C. to about 140° C. for 1 to 5 minutes has been found to be quite practical.

Heating may be carried out using commercial textile processing equipment, e.g. by passing the fiber over heated rollers or through a turbulent air drying oven.

After the heat treatment, the fabric can be washed to remove any excess materials and then further processed under conventional means prior to treatment with a dyestuff or printing.

When using the epoxy compound of formula I, it is preferably prepared just prior to use by admixing the corresponding chlorohydroxylalkyltrialkyl ammonium salt with a base to avoid or at least to minimize the formation of the dihydroxy form caused by degradation of the epoxy compound due to the presence of water, high temperature and high pH.

Figure 2:
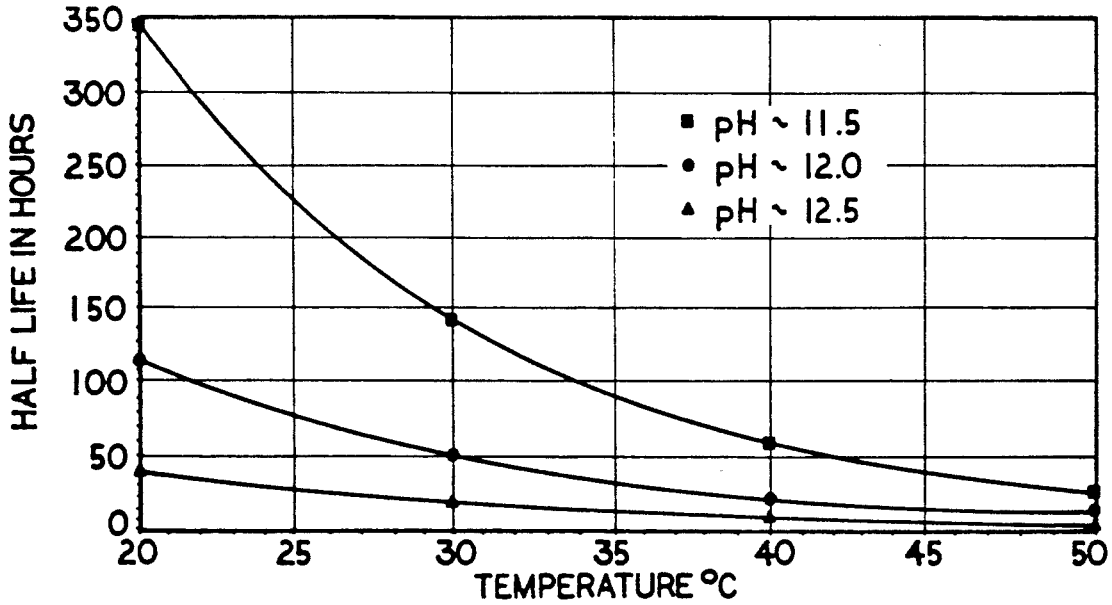
FIG. 2 shows the half life of epoxypropyltrimethylammonium chloride at a pH of 11.5 to 12.5.

FIGS. 1 and 2 show the magnitude of the loss of yield due to the thermal instability of epoxy propyltrimethylammonium chloride derived from a 65% solution of 3-chloro-2-hydroxy propyltrimethylammonium chloride which has been epoxidized using a 10–50% by weight solution of NaOH and which is at a pH between 10.5 and 12.5 at a temperature between 20° C. and 50° C.

An improvement in dyeability, printability and ease of handling at the point of application has also been found with the starting material used to prepare the epoxy ammonium salt, namely a compound of the formula:

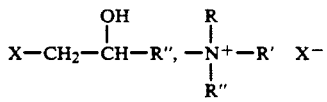

(II)

wherein R, R′, R″, R‴ and X are as hereinbefore described, preferably, chlorohydroxypropyltrimethylammonium chloride.

By using the process of steps of this invention, one can apply a solution of the halohydrin of formula II without the need to premix the halohydrin with a base at the mill, as in a customary practice. Having to premix the chlorohydrin with a base to form the active epoxy compound adds to the loss of the active species due to hydrolysis.

The present invention will now be explained in detail by reference to the following non-limiting examples. Unless otherwise indicated, all percentage are by weight.

EXAMPLE 1

The following experiment was performed to determine the washfast yield of epoxypropyltrimethyl ammonium chloride applied at a rate of 2% dry basis of epoxypropyltrimethylammonium chloride by weight of fabric to cotton fabric precausticized with 3% caustic by weight of fabric.

To 15.38 grams of 65% 3-chloro-2-hydroxypropyltrimethylammonium chloride (Quat 188-The Dow Chemical Company) was added deionized water to make up a 400 gram solution. A 10% NaOH solution was added drop-wise to the Quat 188 solution until a pH of 11 was reached. 21.4 grams of the 10% NaOH solution was required. Two weighed cotton samples were single dipped and padded with a 3% NaOH solution so as to achieve 100% wet pickup, and were dried on pin frames in a Despatch oven at 80 deg. C. for about 3 minutes so as to have less than 8% OWF. The fabric samples were mounted on pin frames and then sprayed with a 2% epoxidized Quat 188 solution from a range of about 12" (30 cm) to be wetted and have a water pickup of less than 50%. The samples were weighed to determine the amount of solution uptake, mounted on a pin frames and then cured without delay for 2 minutes at 120 deg. C., in a Despatch textile curing oven. The samples were then washed by rinsing for 30 minutes in tap water followed by three rinses with deionized water. Several small pieces of fabric were cut from each cured sample, were weighed, and were visually checked for yellowing and then analyzed for nitrogen content using an Antek Total Nitrogen Analyzer. The nitrogen analyses showed the yields of reacted, washfast epoxidized Quat 188 to be 79.49% and 77.02% on the two samples. These yields are considerably higher than that found in U.S. Pat. No. 3,685,953 in spite of the fact that the curing was done for a much shorter time in order to reduce yellowing of the fabric.

The increase in yield shows the importance of pretreating the fabric with caustic and then bringing the pretreated fabric to a dry state.

COMPARATIVE RUN 1

The experiment was performed in order to determine the washfast yield of epoxypropyltrimethyl ammonium chloride.

To 15.38 grams of 65% Quat 188 was added deionized water to make up 400 grams of solution. A 10% NaOH solution was added drop-wise to the Quat 188 solution until a pH of 11 was reached. 21.4 grams of 10% NaOH solution was required. Two weighed cotton Testfabrics Style 400 printcloth samples were predried at 80 deg. C for 3 minutes. The fabric samples were mounted on pin frames and then sprayed with a 2% epoxidized Quat 188 solution from a range of about 12" (30 cm) in a manner to achieve a wet pickup of 100% OWF. The sprayed samples were weighed to determine the amount of solution uptake, mounted on a pin frame, and cured without delay for 2 minutes at 120 deg. C in a Despatch textile curing oven. The samples were then washed by rinsing for 30 minutes in tap water, followed by three rinses with deionized water. Several small pieces of fabric cut from each cured sample were weighed, and were then analyzed for nitrogen content using an Antek Total Nitrogen Analyzer. The nitrogen analyses showed the yield of reacted, washfast epoxidized Quat 188 to be 9.77% and 12.38% on the two samples.

This comparison shows the reduced yields which result from not including caustic in the reacting media.

EXAMPLE 2

This experiment was performed to determine the washfast yield of epoxypropyltrimethylammonium chloride to cotton fabric precausticized with 1% caustic solution.

To 15.38 grams of 65% Quat 188 was added deionized water to make up 400 grams of solution. A 10% NaOH solution was added drop-wise to the Quat 188 solution until a pH of 11 was reached. 21.4 grams of 10% NaOH solution was required. Two weighed cotton samples were single dipped and padded with a 1% NaOH solution so as to achieve 100% wet pickup. The samples were pre-dried at 80 deg. C for 3 minutes so as to have less than 8% OWF. The fabric samples were mounted on pin frames and then sprayed with a 2% epoxidized Quat 188 solution from a range of about 12" (30 cm) to be wetted and have a water pickup of less than 50 %. The samples were weighed to determine the amount of solution uptake. The samples were then mounted on a pin frames and cured without delay for 2 minutes at 120 deg. C in a Despatch textile curing oven. The samples were then rinsed for 30 minutes in tap water followed by three rinses with deionized water. Several small pieces of fabric were cut from each cured sample, were weighed, and were then analyzed for nitrogen content using an Antek Total Nitrogen Analyzer. The nitrogen analyses showed the yields of reacted, washfast epoxidized Quat 188 to be 31.82% and 21.72% on the two samples.

This example shows the importance of the amount of caustic with which the cotton sample was pretreated relative to the amount of epoxy Quat with which the sample was treated.

EXAMPLE 3

This experiment was performed to determine the washfast yield of epoxypropyltrimethylammonium chloride first mixed with NaOH to a pH of approx. 13 and then applied at a rate of 1.65% epoxy compound dry basis of epoxypropyltrimethylammonium chloride by weight of fabric to dry untreated cotton fabric.

To 15.38 grams of 65% Quat 188 was added deionized water to make up 400 grams of solution. A 10% NaOH solution was added drop wise to the Quat 188 solution until a pH of 11 was reached. 21.4 grams of 10% NaOH solution was required. A sample of Testfabrics Style 400 printcloth was cut, predried at 80 deg. C for 3 minutes and weighed. A 2% epoxidized Quat 188 solution was placed in a beaker with a magnetic stirrer together with a precalibrated Corning combination pH electrode. 10% NaOH was added to the 2% solution to obtain a pH of 13. The caustic treated solution was poured, without delay into a 8" (20 cm)×10" (25 cm) Pyrex baking dish immersed in an ice bath to maintain the treating solution near 0° C. to minimize hydrolysis of the epoxide to the inactive dihydroxy alkyl compound. The sample was then dipped until visibly wetted throughout and padded without delay and weighed. The calculated amount of dry add-on Quat organic was found to be 1.65%. The fabric sample was placed on a pin frame and after exactly 5 minutes from treatment, it was placed in a Despatch oven to cure for 2 minutes at 120 deg. C. The cotton fabric was then rinsed for 30 minutes in tap water followed by three rinses with deionized water. Several small pieces of fabric were cut from each cured sample, were weighed, and were then analyzed for nitrogen content using an Antek Total Nitrogen Analyzer. The nitrogen analyses showed the yields of reacted, washfast Quat 188 to be 64.67%, a greater yield than that found in U.S. Pat. No. 3,685,953.

This experiment shows the importance of minimizing the time duration during which the epoxy reagent is in the presence of water at an elevated pH. By lowering the temperature of the reagent bath, the reaction rate was reduced to the point that yield loss due to hydrolysis was less than usually encountered during the padding operation and before the water was removed by drying.

COMPARISON 2

This experiment was performed to determine the washfast yield of 3-chloro-2-hydroxypropyltrimethylammonium chloride first mixed with NaOH at a concentration of approximately 2% and then applied at a rate of 6.0% organic compound dry add-on to dry untreated cotton fabric and was cured for 3 minutes at 120 deg. C on a pin frame in a Despatch oven. This was performed to verify data from example 13 of U.S. Pat. No. 3,685,953. The patent example used the same caustic and organic concentrations but used a cure time of 10 minutes at 120 deg. C. The patent example did not call for low temperature handling of the solution nor did it give any indication of the age of the solutions used. Since these factors were undefined, this sample was mixed and used at or near zero degrees C. The sample was cured with absolutely no delay after the padding operation. The one deviation from Example 13 in U.S. Pat. No. 3,685,953 is that a shorter cure time of 180 seconds at 120 degrees C. was used instead of the 10 minutes of the example, since it was known that the cited cure conditions would give severe yellowing of the sample. 18.5 grams of 65% Quat 188 chilled to approximately 0 deg. C was weighed into a tared beaker. A solution of 40 grams of 10% NaOH diluted to 181.5 grams and chilled to 0 deg. C, was added to the chilled Quat 188. A sample of Testfabrics Style 400 printcloth was cut, pre-dried at 80 deg. C for 3 minutes and weighed. The chilled solution was poured into a 8" (20 cm)×10" (25 cm) Pyrex baking dish immersed in an ice bath, the fabric sample was then dipped until visibly wetted throughout, and padded without delay to have a water pickup of less than 50 %. The fabric sample was then quickly put on a pin frame and placed in a Despatch oven to cure for 180 seconds at 120 deg. C. The cotton fabric was then rinsed for 30 minutes in tap water followed by three rinses with deionized water. Several small pieces of fabric were cut from each cured sample, were weighed, and were then analyzed for nitrogen content using an Antek Total Nitrogen Analyzer. The nitrogen analyses showed the yields of reacted, washfast epoxidized Quat 188 to be 48.81%..

The results thus obtained were only slightly lower than the 55% yield cited in Example 13 of U.S. Pat. No. 3,685,953 and this difference is probably due to the reduced curing time required to reduce fabric yellowing.

COMPARISON RUN 3

This experiment was performed to verify data from U.S. Pat. No. 3,685,953. It differs from Comparison Run 2 only in curing conditions. This experiment duplicates the curing time, (10 minutes) of the cited patent as well as all of the other conditions. The yield of washfast 3-chloro-2-hydroxy propyltrimethylammonium chloride was found to be 55%. The sample showed severe yellowing which was not removed with washing. This was in agreement with the cited 55% yield in Patent No. 3,685,953.

EXAMPLE 4

This experiment was performed to determine the yield possible from the application of propyltrimethylammonium chloride to precausticized very dry cotton fabric. The experiment was performed using 3-chloro-2-hydroxypropyltrimethylammonium chloride (Quat 188) applied at a rate of 2% dry add-on to cotton fabric precausticized with 3% caustic add-on and then dried. 65% Quat 188 was diluted with deionized water to make up 200 g. of 2% active ingredient solution. A cotton sample was single dipped and padded with a 3% NaOH solution so as to achieve 100% wet pickup. The sample was pre-dried at 80 deg. C for 3 minutes followed by drying with bone dry nitrogen at room temperature for 16 hours. The causticized and dried sample was mounted on a pin frame and sprayed from a range of about 12" (30 cm) with a 2% epoxidized Quat 188 solution. The sample was weighed to determine the amount of solution uptake. The sample was then mounted on a pin frame and cured without delay for 2 minutes at 120 deg. C in a Despatch textile curing oven. The sample was then rinsed for 30 minutes in tap water followed by three rinses with deionized water. Several small pieces of fabric were cut from each cured sample, were weighed, and were then analyzed for nitrogen content using an Antek Total Nitrogen Analyzer. The nitrogen analysis showed the yield of reacted, washfast Quat 188 to be 61.6%. This yield was appreciably higher than the yield of 55% cited in U.S. Pat. No. 3,685,953 and utilized curing conditions which were less severe, resulting in much less irreversible yellowing of the fabric.

Based on the yield achieved in Example 1 using the epoxy compound, it is expected that a further improved yield above the 61.6% obtained in this experiment could be achieved by increasing the caustic to 3-chloro-2-hydroxytrimethylammonium chloride ratio, preferably by reducing the concentration of the chlorohydrin rather than increasing the caustic to minimize risk of yellowing.

What is claimed is:

1. A process for improving the printability and dyeability of a fabric or fiber containing a polyhydroxylized polymer which comprises the steps of:

A. treating said fabric or fiber with a dilute alkaline solution;

B. drying the fabric or fiber from step A so as to contain less than 8% water on weight fabric or fiber;

C. treating the dry fabric or fiber from step B with a dilute solution of an epoxy ammonium salt of the formula:

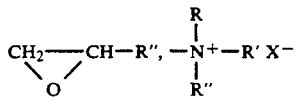

(I)

wherein R, R' and R'' are alkyl radicals each independently having 1 to 20 carbon atoms, R''' is an alkylene radical having 1 to 20 carbon atoms, and X— is an anion selected from the group consisting of sulfate, sulfonate and halide, under the condition whereby the fabric or fiber is wetted and comprises less than about 50% by weight of water, and then D. heating the treated fabric or fiber from step C at a temperature at least about 70° C. for a period of time sufficient to effect fixation of the epoxy compound without causing irreversible yellowing.

2. A process for improving the printability and dyeability of a cotton fabric or fiber which comprises the steps of;

A. treating said fabric or fiber with a dilute caustic solution;

B. drying the fabric or fiber from step A so as to contain less than 8% water on weight fabric or fiber;

C. treating the dry fabric or fiber from step B with a dilute solution of epoxypropyltrimethylammonium chloride, whereby the fabric or fiber is wetted and comprises less than about 50% by weight of water; and then D. heating the treated fabric or fiber from step C at a temperature at least about 100° C. for a period of time sufficient to effect fixation of the epoxy compound without causing irreversible yellowing.

3. A process for improving the printability and dyeability of a fabric or fiber containing polyhydroxylized polymers which comprises the steps of:

A. treating said fabric or fiber with a dilute alkaline solution;

B. drying the fabric or fiber from step A so as to contain less than 8% on water fabric or fiber;

C. treating the dry fabric or fiber from step B with a dilute solution of ammonium salt of the formula

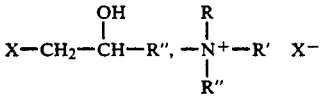

(II)

wherein R, R′ and R″ are alkyl radials each independently having 1 to 20 carbon atoms, R‴ is an alkylene radical having 1 to 20 carbon atoms, and X is selected from the group consisting of sulfate, sulfonate and halide, under the condition whereby the fabric or fiber is wetted and comprises less than 50% by weight of water; and then D. heating the treated fabric or fiber from step C at a temperature at least about 70° C. for a period of time sufficient to effect fixation of the ammonium salt on the fabric without causing irreversible yellowing.

4. A process for improving the printability and dyeability of a cotton fabric which comprises the steps of:

A. treating said fabric or fiber with a dilute caustic solution;

B. drying the fabric or fiber from step A so as to have less than 8% of water on weight fabric;

C. treating the dry fabric or fiber from step B with a dilute solution of epoxypropyltrimethylammonium chloride at a pH of about 11 to pH 13 with said solution maintained at a temperature of less than ambient in order to minimize the reaction of the reagent with the water in the solution, and then D. flash drying the treated fabric from step C at a temperature at least about 100° C. for a period of time sufficient to effect fixation of the epoxy compound without causing irreversible yellowing.

5. A process for improving the printability and dyeability of a cotton fabric which comprises the steps of:

A. treating said fabric with a dilute caustic solution;

B. drying the fabric from step A so as to have less than about 8% of water on weight fabric;

C. treating the dry fabric from step B with a solution of 3-chloro-2-hydroxypropyltrimethylammonium chloride at a pH of about 11 to pH 13 with said solution maintained at a temperature of about 0 degrees C. in order to minimize the reaction of the reagent with the water in the solution, and then D. curing the treated fabric from step C at a temperature at least about 100° C. without causing irreversible yellowing.

6. A process for reacting an epoxy ammonium salt of the formula:

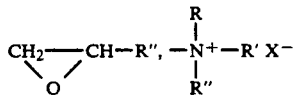

(I)

wherein R, R′ and R″ are alkyl radicals each independently having 1 to 20 carbon atoms, R‴ is an alkylene radical having 1 to 20 carbon atoms, and X— is an anion selected from the group consisting of sulfate, sulfonate and halide, with a polyhydroxylized polymer in the form of a fabric or fiber, at a basic pH, characterized by, in sequence:

A. contacting said polymer with an aqueous solution of at least one alkali metal hydroxide or alkaline earth metal hydroxide base in a concentration which is sufficient, when steps B and C are carried out, to promote reaction of the epoxy ammonium salt with the polymer;

B. drying the fabric or fiber so as to contain less than 8% water on weight fabric or fiber;

C. contacting the polymer with the epoxy ammonium salt; and

D. heating the contacted polymer from step C at a temperature at least about 70° C. without causing irreversible yellowing.

7. A process for improving the printability and dyeability of a fabric or fiber containing a polyhydroxylized polymer which comprises the steps of:

A. treating said fabric or fiber with a dilute alkaline solution;

B. drying the fabric or fiber from step A so as to contain less than 8% water on weight fabric or fiber;

C. treating the dry fabric or fiber from step B with a dilute solution of an epoxy ammonium salt of the formula:

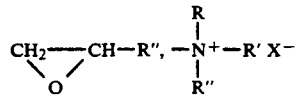

(I)

wherein R, R′ and R″ are alkyl radicals each independently having 1 to 20 carbon atoms, R‴ is an alkylene radical having 1 to 20 carbon atoms, and X— is an anion selected from the group consisting of sulfate, sulfonate and halide, under the condition whereby the fabric or fiber is wetted and comprises less than about 50% by weight of water, and then D. heating the treated fabric or fiber from step C at a temperature at least about 70° C. and in a low humidity environment.

8. The process of claim 7 wherein the fabric or fiber in step A is treated with a dilute caustic solution so as to form a sodium etherate with the hydroxyl units of the polymer.

9. The process of claim 7 wherein said alkaline solution comprises about 2 to 4% of an alkali metal solution.

10. The process of claim 7 wherein the dry fabric or fiber from step B has less than about 0.5% water on weight fabric or fiber.

11. The process of claim 7 wherein said fabric or fiber comprises cotton.

12. The process of claim 7 wherein the solution of step C is substantially free of dihydroxyalkyltrialkylammonium salts.

13. The process of claim 12 wherein the solution of step C is substantially free of 2,3-dihydroxypropyltrimethylammonium chloride.

14. The process of claim 7 wherein said epoxy ammonium salt is epoxypropyltrimethylammonium chloride.

15. The process of claim 7 wherein the fabric or fiber of step B is dried at a temperature of from about 70° to about 150° C.

16. The process of claim 7 wherein the dilute solution of step C is sprayed on said fabric.

17. The process of claim 16 wherein the concentration of said dilute solution in step C is about 0.1 to 10% by weight of epoxy ammonium compound.

18. The process of claim 7 wherein the concentration of said alkaline solution is about 2 to 10% by weight of an alkali metal hydroxide or alkaline earth metal hydroxide.

19. A process for improving the printability and dyeability of a cotton fabrics or fibers which comprises the steps of:

A. treating said fabric or fiber with a dilute caustic solution;

B. drying the fabric or fiber from step A so as to have less than about 8% water on weight fabric or fiber;

C. treating the dry fabric or fiber from step B with a dilute solution of epoxypropyltrimethylammonium chloride, whereby the fabric or fiber is wetted and comprises less than about 50% by weight of water; and then D. heating the treated fabric or fiber from step C at a temperature at least about 100° C. and 120° C. and in a low humidity environment.

20. A process for improving the printability and dyeability of a fabric or fiber containing polyhydroxylized polymers which comprises the steps of:

A. treating said fabric or fiber with a dilute alkaline solution;

B. drying the fabric or fiber from step A so as to have less than about 8% water on fabric or fiber;

C. treating the dry fabric or fiber from step B with a dilute solution of ammonium salt of the formula

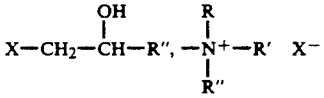

(II)

wherein R, R' and R'' are alkyl radials each independently having 1 to 20 carbon atoms, R''' is an alkylene radical having 1 to 20 carbon atoms, and X is selected from the group consisting of sulfate, sulfonate and halide, under the condition whereby the fabric or fiber is wetted and comprises less than 50% by weight of water; and then D. heating the treated fabric or fiber from step C at a temperature at least about 70° C. and in a low humidity environment so as to fix the ammonium salt on the fabric.

21. The process of claim 20 wherein said fabric or fiber is cotton.

22. The process of claim 20 wherein said ammonium compound is 3-chloro-2-hydroxypropyltrimethylammonium chloride.

23. A process for improving the printability and dyeability of a cotton fabric which comprises the steps of:

A. treating said fabric or fiber with a dilute caustic solution;

B. drying the fabric or fiber from step A so as to have less than about 8% water on weight fabric;

C. treating the dry fabric or fiber from step B with a dilute solution of epoxypropyltrimethylammonium chloride at a pH of about 11 to pH 13 with said solution maintained at a temperature of less than ambient in order to minimize the reaction of the reagent with the water in the solution, and then D. flash drying the treated fabric from step C at a temperature at least about 100 and 120 degrees C. and in a low humidity environment.

24. The process of claim 23 wherein said temperature of the solution of step C is about 0° C.

25. A process for improving the printability and dyeability of a cotton fabric which comprises the steps of:

A. treating said fabric with a dilute caustic solution;

B. drying the fabric from step A so as to have less than about 8% water on weight fabric;

C. treating the dry fabric from step B with a solution of an 3-chloro-2-hydroxypropyltrimethylammonium chloride at a pH of about 11 to pH 13 with said solution maintained at a temperature of 0 degrees C. in order to minimize the reaction of the reagent with the water in the solution, and then D. curing the treated fabric from step C at a temperature at least about 100 and 120 degrees C. and in a low humidity environment.

26. A process for reacting an epoxy ammonium salt of the formula

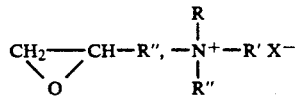

(I)

wherein R, R' and R'' are alkyl radicals each independently having 1 to 20 carbon atoms, R''' is an alkylene radical having 1 to 20 carbon atoms, and X− is an anion selected from the group consisting of sulfate, sulfonate and halide, with a polyhydroxylized polymer in the form of a fabric or fiber, at a basic pH, characterized by, in sequence:

A. contacting said polymer with an aqueous solution of at least one alkali metal hydroxide or alkaline earth metal hydroxide base in a concentration which is sufficient, when steps B and C are carried out, to promote reaction of the epoxy ammonium salt with the polymer;

B. drying the fabric or fiber so as to contain less than 8% water on weight fabric or fiber;

C. contacting the polymer with the epoxy ammonium salt; and

D. heating contacted polymer from step C at a temperature at least about 70° C. and in a low humidity environment.

27. The process of claim 26 wherein the polymer is cotton, the aqueous solution used in Step A is an aqueous solution of from about 2 to about 4 weight percent sodium hydroxide, the epoxy ammonium salt is epoxypropyltrimethylammonium chloride, and the treated fabric or fiber is flashed dried at a temperature of from about 70° C. to about 180° C. for about 2 to about 5 minutes sufficient to react the epoxy ammonium salt with the cotton without causing irreversible yellowing.

28. The process of claim 26 wherein the dried fabric or fiber from step B includes unreacted residue of the base and step C includes (i) contacting the dried fabric or fiber from step B with a dilute solution of at least one compound of the formula $$X-CH_2-\underset{}{\overset{OH}{\overset{|}{C}}}H-R'', -\overset{R}{\underset{R''}{\overset{|}{\underset{|}{N}}}}^{+}-R' \quad X^- \qquad \text{(II)}$$

wherein R, R′ and R″ are alkyl radials each independently having 1 to 20 carbon atoms, R‴ is an alkylene radical having 1 to 20 carbon atoms, and X is selected from the group consisting of sulfate, sulfonate and halide, and (ii) reacting said compound with unreacted residue of the base to form the epoxy ammonium salt in situ.

29. The process of claim 28 wherein the polymer is cotton, the aqueous solution used in step A is an aqueous solution of from about 2 to about 4 weight percent sodium hydroxide, the epoxy ammonium salt is epoxypropyltrimethylammonium chloride, and the treated fabric or fiber is flashed dried at a temperature of from about 70° C. to about 180° C. for about 2 to about 5 minutes sufficient to react to the epoxy ammonium salt with the cotton without causing irreversible yellowing.

* * * * *

UNITED STATES PATENT AND TRADEMARK OFFICE

CERTIFICATE OF CORRECTION

PATENT NO. : 5,320,646

DATED : June 14, 1994

INVENTOR(S) : Robert T. Patton et al.

It is certified that error appears in the above-identified patent and that said Letters Patent is hereby corrected as shown below:

On the cover page, under ABSTRACT, in formula (I), "-R",-" should read -- -R" '- --.

On the cover page, under ABSTRACT, in formula (II), "-R",-" should read -- -R" '- --.

In column 1, line 40, in formula (I), "-R",-" should read -- -R" '- --.

In column 1, line 46, after "atoms", insert --,--.

In column 3, line 5, in formula (I), "-R",-" should read -- -R" '- --.

In column 3, line 10, in formula (II), "-R",-" should read -- -R" '- --.

In column 3, line 65, in formula (I), "-R",-" should read -- -R" '- --.

In column 6, line 50, in formula (II), "-R",-" should read -- -R" '- --.

In claim 1, column 10, line 60, in formula (I), "-R",-" should read -- -R" '- --.

In claim 2, column 11, line 15, delete "contain", insert --have--.

In claim 2, column 11, line 15, after "than", insert --about--.

UNITED STATES PATENT AND TRADEMARK OFFICE

CERTIFICATE OF CORRECTION

PATENT NO. : 5,320,646

DATED : June 14, 1994

INVENTOR(S) : Robert T. Patton et al.

It is certified that error appears in the above-identified patent and that said Letters Patent is hereby corrected as shown below:

In claim 3, column 11, line 33, delete "contain", insert --have--.

In claim 3, column 11, line 40, in formula (II), "-R",-" should read -- - R" '- --.

In claim 4, column 11, line 59, delete --or fiber--.

In claim 4, column 11, line 61, delete --or fiber--.

In claim 6, column 12, line 20, in formula (I), "-R",-" should read -- - R" '- --.

In claim 7, column 12, line 60, in formula (I), "-R",-" should read -- - R" '- --.

In claim 19, column 13, line 50, delete "at least", insert --between--.

In claim 20, column 13, line 60, after "of", insert --an--.

In claim 20, column 13, line 65, in formula (II), "-R",-" should read -- - R" '- --.

UNITED STATES PATENT AND TRADEMARK OFFICE

CERTIFICATE OF CORRECTION

PATENT NO. : 5,320,646

DATED : June 14, 1994

INVENTOR(S) : Robert T. Patton et al.

It is certified that error appears in the above-identified patent and that said Letters Patent is hereby corrected as shown below:

In claim 23, column 14, line 21, after "8%", insert --of--.

In claim 23, column 14, line 22, delete --or fiber--.

In claim 23, column 14, line 28, delete "at least", insert --between--.

In claim 25, column 14, line 45, delete "at least", insert --between--.

In claim 26, column 14, line 50, in formula (I), "-R",-" should read -- -R" '- --.

In claim 28, column 16, line 5, in formula (II), "-R",-" should read -- -R" '- --.

Signed and Sealed this

Twenty-first Day of February, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,320,646

DATED : June 14, 1994

INVENTOR(S) : Robert T. Patton et al.

It is certified that error appears in the above-identified patent and that said Letters Patent is hereby corrected as shown below:

In claim 3, column 11, line 33, after "than", delete "8%", insert -- about 8% weight--.

Signed and Sealed this

Twenty-first Day of March, 1995

*Attest:*

Bruce Lehman

BRUCE LEHMAN

*Attesting Officer*

*Commissioner of Patents and Trademarks*